United States Patent [19]

Hodges

[11] Patent Number: 4,609,419

[45] Date of Patent: Sep. 2, 1986

[54] HOSIERY TOE CLOSING METHOD AND APPARATUS

[75] Inventor: Michael J. Hodges, High Wycombe, England

[73] Assignee: Detexomat Machinery Limited, Buckinghamshire, England

[21] Appl. No.: 766,566

[22] Filed: Aug. 19, 1985

[30] Foreign Application Priority Data

Sep. 5, 1984 [GB] United Kingdom ..... 8422370

[51] Int. Cl.[4] ..... B32B 31/02

[52] U.S. Cl. ..... 156/152; 2/239; 2/275; 112/121.15; 112/262.2; 156/93; 156/163

[58] Field of Search ..... 2/239, 275; 66/187; 112/121.15, 262.2; 156/93, 152, 163, 198, 494; 223/112

[56] References Cited

U.S. PATENT DOCUMENTS

| | | | |
|---|---|---|---|
| 2,980,917 | 4/1961 | Slane | 112/262.2 X |
| 3,090,963 | 5/1963 | Wittman | 112/262.2 X |
| 4,102,727 | 7/1978 | Bell | 223/112 X |
| 4,133,280 | 1/1979 | Takatori et al. | 112/262.2 |
| 4,359,956 | 11/1982 | Sakonishi | 112/262.2 |
| 4,383,490 | 5/1983 | Hodges | 112/121.15 |
| 4,383,491 | 5/1983 | Hodges | 112/262.2 |
| 4,538,534 | 9/1985 | Frazier et al. | 112/262.2 |

*Primary Examiner*—Robert A. Dawson

*Attorney, Agent, or Firm*—Dority & Manning

[57] ABSTRACT

Toe closing socks first involves stretching them flat on a carrier, then one of the resulting confronting layers of fabric is effectively held substantially immobile by a fabric-holding device and the other layer is displaced longitudinally relative thereto by a movable displacing means brought into engagement therewith. Maintaining the layers mutually displaced, for example by clamping them to one another, they are conveyed past a sewing machine and seamed. By seaming the layers together while they are mutually displaced, the seam will adopt an overfoot or underfoot position in the finished sock due to readjustment of the fabric and the return of the layers to their normal relaxed relative dispositions.

22 Claims, 19 Drawing Figures

HOSIERY TOE CLOSING METHOD AND APPARATUS

The present invention relates to a hosiery toe closing method and apparatus.

More particularly, but not exclusively, the invention concerns the toe closing of socks. Stockings or pantihose could be toe closed by means of this invention if they are of heavy rather than sheer knit form.

As is well known, hosiery is knitted in a tubular form. One end of each tube blank has to be closed in some way, to form the toe end. Two toe closing techniques are in general use. These techniques are diagrammatically illustrated in the accompanying FIG. 1(*a*) to (*d*) to which reference is now directed.

Figure 1A:
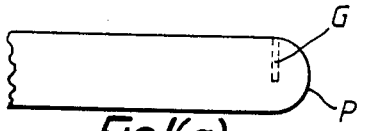
Figure 1C:
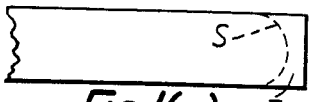
Figure 1B:
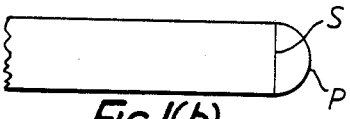
Figure 1D:
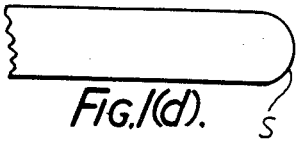
Figure 2A:
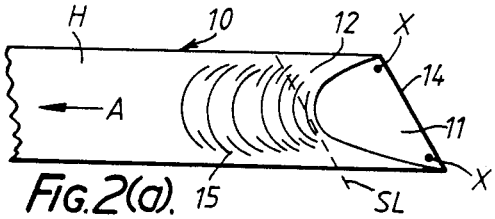
Figure 2C:
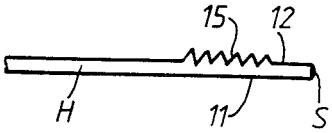
Figure 2B:
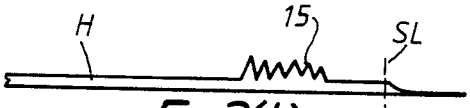
Figure 2D:
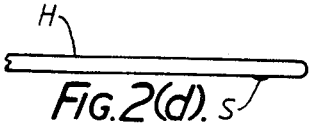
Figure 2E:
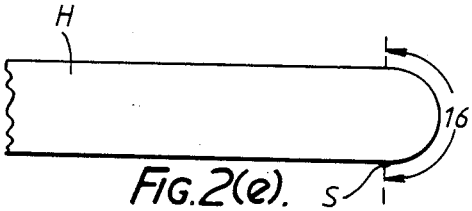

One technique involves reciprocating the knitting machine during the knitting operation to form what is known as a reciprocated toe or pouch P, see FIG. 1*a, b.* When the knitting operation is complete, there is a gap G between the end edge of the pouch P and the adjacent portion of the knit. The confronting knit edges form the "per line" and have to be seamed together to finish the hose toe. Having produced the sock with a reciprocated toe, the closure is usually effected by automatic looper line closing machines or by a simple overlock sewing machine, to form the seam S. This technique is sometimes referred to as "looper line" toe closing.

The second technique is to knit a straight tubular hose blank toe and to close it by hand seaming or by automatic machines such as the Detexomat (RTM) Speedomatic (RTM) half hose toe closer. Using such a machine, the hose blank is disposed in a laid-flat condition, clamped along the intended seam line S (see FIG. 1*c, d*) and then moved past the seamer, e.g. an overlock machine, to form the curved seam S. Beyond the seam S the knitted material T is waste and is trimmed off during or after seaming.

Neither technique is ideal, however. The looper line approach can produce good seams comfortable to the wearer, but closing along the looper line is relatively slow, even when costly looper line closing machines are employed. Care must be taken to load the hose properly into the looper line machine.

The alternative technique is well established, especially in the manufacture of conventional ladies stockings and pantihose. Excellent production rates are attained. The technique is not entirely suited to sock production, however. Apart from the waste factor, there is a drawback in that the seam may not be as comfortable as desired. The seam S, which is somewhat bulky, lies across the ends of the wearer's toes where it may cause some discomfort. For preference, the seam should be above the wearer's toes or beneath them, in the hollow between the toes and the ball of the foot. The standard toe closing technique cannot readily emulate the looper line technique in so locating the seam.

The present invention aims to achieve production rates approaching those of the conventional toe closing technique while obtaining seams or joins akin in location to those produced by the looper line technique.

By appropriately manipulating the tubular hose blank before seaming, the seam or join can be caused to adopt an over-foot or under-foot position simply and of its own accord. Actual seaming or joining can be carried out along a straight line path or along a chosen curve if a deeper or shallower toe end were required, for instance.

According to the present invention, there is provided a method for closing the toe of a tubular hose blank comprising the steps of:

(a) placing said blank in a flattened condition defining juxtaposed layers at an open end of same;

(b) longitudinally displacing one of said layers with respect to said other layer; and (c) joining said layers along a predetermined line across said blank while maintaining the relative displacement between said layers.

The action of establishing the mutual displacement appears to produce a complex tensioning of the fabric and in effect create a surplusage of fabric in one of the layers. When the join is completed and the hose is released, the surplusage will redistribute itself in the hose thanks to a relaxation of the fabric. In consequence of the redistribution, the join becomes positioned somewhat away from the actual toe end of the hose. If the laid-flat blank were appropriately oriented at the outset, with the intended top and bottom portions of the finished hose being constituted by the said two layers, then the join can ultimately adopt an over-foot or under-foot configuration. The resulting hose will closely resemble a hose closed by the much slower looper line technique.

A movable clamp device can be employed to convey the hose past means for joining the layers, thereby to generate the toe-closing join, so long as the mutual displacement of the layers is preserved during the movement. Suitable clamp devices are known and are disclosed in our patents GB-B-1,039,104; GB-B-1,501,869; GB-B-1,577,758 and GB-B-2,074,203. By appropriate movement of the clamp device, the join can be formed along a line of predetermined shape which may be linear or curved.

The toe-closing join will preferably be made by sewing, e.g. overlock sewing. Other joining methods could be adopted in appropriate cases, e.g. ultrasonic welding.

In performing the present method, it is preferred to displace one layer positively relative to the other while the latter is effectively restrained in some way from being displaced. The said one layer can be pushed longitudinally away from the end edge of the said other layer.

Also according to the present invention, there is provided apparatus for closing the toe of a tubular hose blank comprising:

(a) means for mounting said blank in a flattened condition with juxtaposed layers at an outer, open end of same;

(b) means for relatively displacing at least one of said layers with respect to the other layer to establish a predetermined mutual displacement between said layers;

(c) clamping means for receiving a toe end of said blank supported on said mounting means; and (d) means for joining said layers along a predetermined line across said blank; said clamping means being operative (i) to grip said toe end after establishment of said displacement, (ii) to convey said toe end past the joining means for the latter to join the layers along said line and (iii) to preserve said displacement while conveying said toe end past the joining means.

Blanks to be toe closed by the apparatus need no reciprocated toe or pouch and hence the knitting thereof is simplified. The apparatus can conveniently comprise an adaptation of known types of toe closer.

The preferred mounting means comprises a pair of spaced-apart, flat blades or fingers. They may be movable apart to stretch the hose toe end laterally to establish the laid-flat condition. The blades can be associated with a suction tube for everting the hose blank.

In the preferred apparatus, the holding means serves to immobilise a part or parts of the blank toe end while the displacing means acts on one of said layers and thereby establishes the said mutual displacement. Once the clamp mechanism of the toe closer has gripped the hose, the holding means may thereafter disengage from the toe end. The displacement means can comprise a reciprocally-movable element engageable with the said second layer, said element being disengageable therefrom after executing a displacing stroke when the clamp has gripped the toe end.

The preferred clmap mechanism comprises an endless flexible belt and a cooperating support between which the hose toe end is gripped, the belt being movable to advance the toe end across the support past the seamer. Conveniently, at a toe end receiving part of the clamp, the clamp comprises belt-shaping means which enable the belt to grip the toe end along a predetermined linear or curvilinear line corresponding to the configuration of a predetermined seam line.

If desired, the clamp could be omitted, where the toe closer has the mounting means supported to move past the joining means appropriately for the latter to join the layers of the passing toe end. The means to displace the layers relative to one another will move in step with the mounting means to maintain the mutual displacement while joining proceeds.

Accordingly, the present invention also provides apparatus for closing the toe of a tubular hose blank comprising:

(a) means for mounting said blank in a flattened condition with juxtaposed layers at an outer, open end of same;

(b) means for relatively displacing one of said blank layers longitudinally with respect to said other layer and maintaining the longitudinal relative displacement; and (c) means for joining said blank layers along a predetermined line across said blank while said longitudinal relative displacement is maintained.

The said displacing means is movable with the carrier and is operable to maintain the said displacement during joining the layers at the toe end.

Figure 3A:
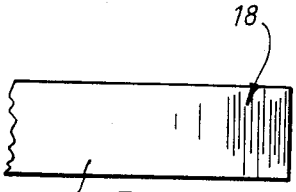
Figure 3B:
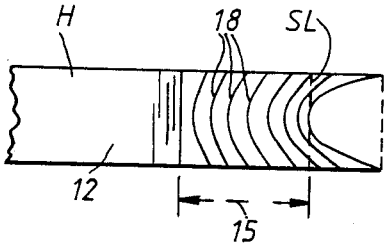
Figure 3C:
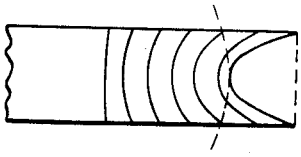
Figure 4:
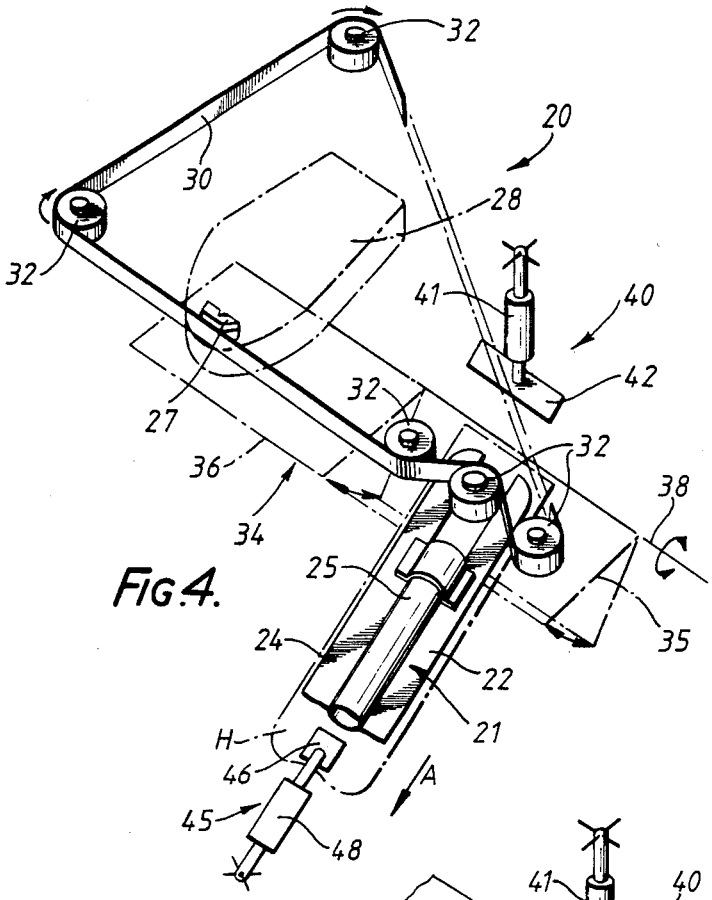
Figure 5:
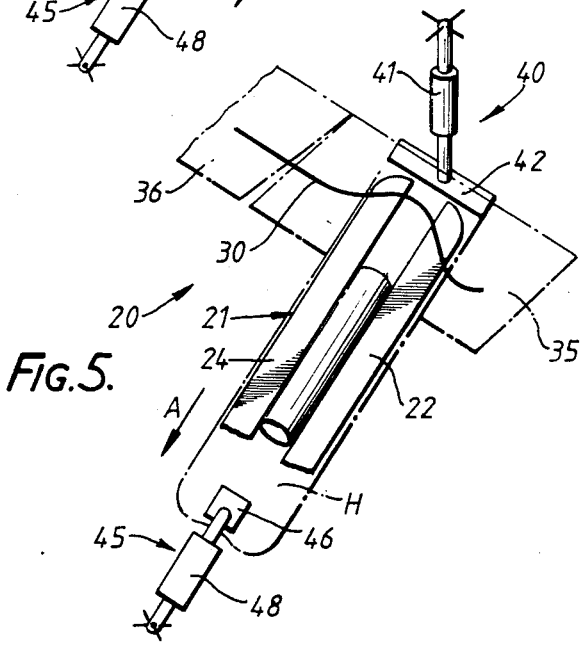
Figure 6:
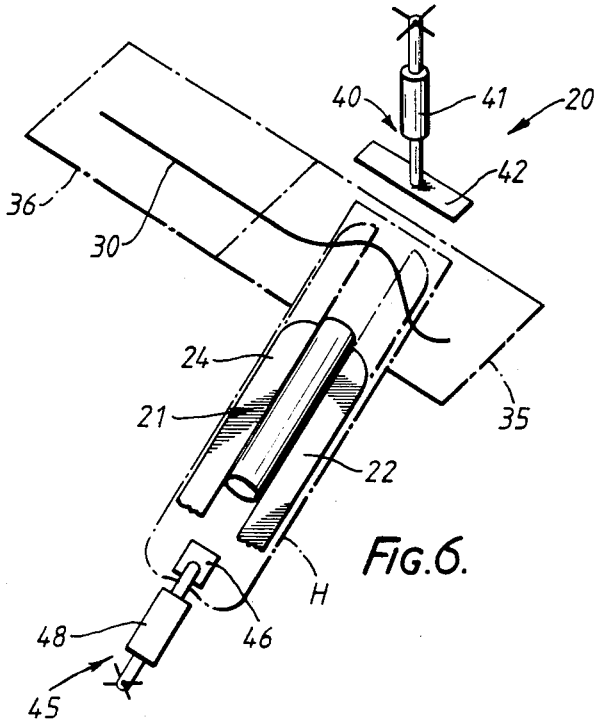
Figure 7:
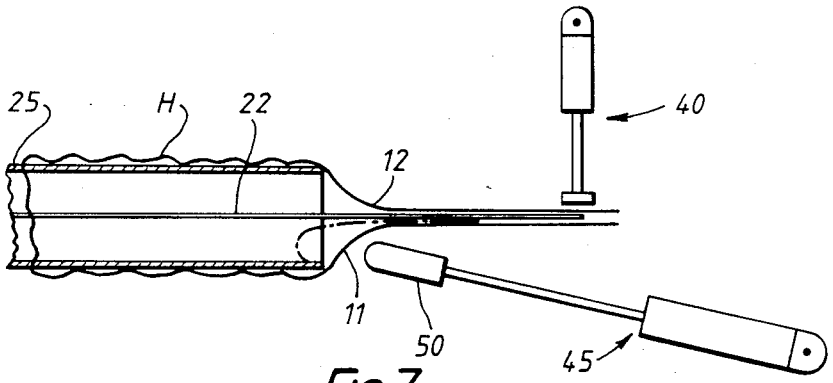
Figure 8C:
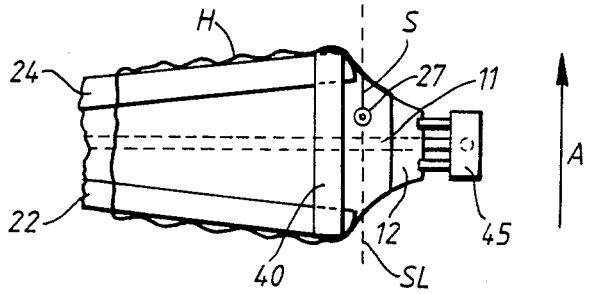
Figure 8B:
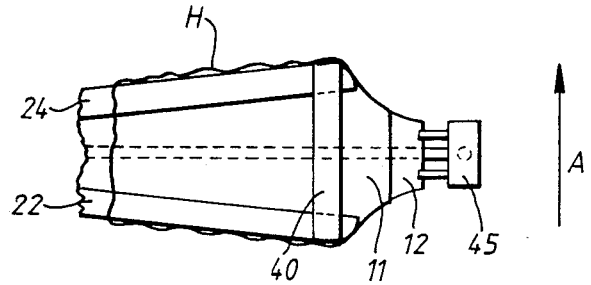
Figure 8A:
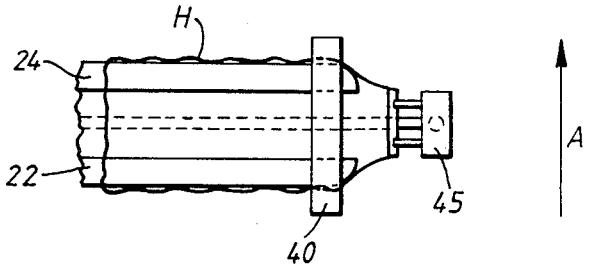

The invention will now be explained in more detail with reference to the accompanying drawings, in which:

FIGS. 1(*a*) and 1(*b*) are side and top views illustrative of the known looper line toe closing technique, and FIGS. 1(*c*) and 1(*d*) are "before and after", top views illustrative of toe closing using tubular blanks;

FIGS. 2(*a*) to 2(*e*) diagrammatically illustrate toe closing according to this invention, FIGS. 3(*a*) to 3(*c*) diagrammatically illustrate the condition of the knitted fabric during toe closing according to this invention, FIG. 4 illustrates in simplified form a perspective view of apparatus according to the invention, FIGS. 5 and 6 illustrate in further simplified form certain stages in the operation of the apparatus, FIG. 7 diagrammatically illustrates another embodiment of the invention, and FIGS. 8(*a*) to 8(*c*) schematically illustrate the principles of operation of another apparatus embodying the invention.

The two conventional toe closing techniques have already been discussed in connection with FIGS. 1(*a*) to (*d*). By this invention, we are seeking to produce a closed hose toe which resembles a reciprocated toe in having an over- or under-foot seam, yet is susceptible of production from the simpler tubular type of hose blank. The method according to this invention can be implemented by an adaptation of a known toe closer type such as is disclosed in the aforementioned patent specifications e.g. GB-B-1,577,758. Such toe closers can achieve extremely high production rates, much higher than present looper line toe closers.

FIGS. 2(*a*) to (*e*) conveniently show the steps of our preferred method. A tubular hose blank H, or at least the toe end portion 10 thereof, is first placed in a laid-flat condition. The condition is most readily attained by laterally stretching the blank H, for example by placing it on a suitably dimensioned flat form, not shown. In the laid-flat condition, first and second layers 11, 12 of the hose fabric closely confront one another.

In the second step of the method, part of the toe end, e.g. the free end 14 of layer 11, is restrained from moving and layer 12 is pulled or pushed longitudinally in the direction A away from the end 14 of layer 11. The corresponding free end of layer 12 is drawn backwardly from end 14 and assumes a curved form as shown. Thanks to this second step of the method, an effective surplusage 15 of loose hose fabric is created or accumulated in layer 12. Moreover, the distortion of the fabric sets up a complex state of tension in the two layers 11, 12. The relative displacement between layers 11, 12 determines how much surplusage 15 is accumulated.

Having established a predetermined mutual displacement between layers 11, 12, the next step involves securing the layers so as to maintain the said displacement, e.g. by clamping them together adjacent the intended seam line SL. Seam line SL as illustrated is linear, but it could be curved. Clamping of the layers has to preserve the mutual displacement until the required seam has been generated.

The fourth step of the method accomplishes seaming along line SL by conveying the hose toe end past a seamer, with its layers 11, 12 still retaining their mutual displacement. The seamer is preferably a known sewing and trimming machine. The seamer generates the seam S as the toe end passes thereby and trims away waste. The waste comprises fabric to the right of the seam line SL, as viewed in FIG. 2(*a*).

After seaming and while the toe end is still in the laid-flat condition, the hose toe can be visualised in side elevation as shown in FIG. 2(*c*). The seam S extends transversely of the blank H and is at the extreme end thereof. The loose surplusage 15 is still located in layer 12 rearwardly of the seam S. Upon releasing the hose from the laid-flat condition, its fabric will relax of its own accord and commence to redistribute itself. The surplusage 15 will move towards the hose toe end portion and the seam S will move towards an under- or over-foot position, see FIG. 2(*d*). FIG. 2(*e*) illustrates the resulting toe closer hose as seen from the side. The toe portion 16 is formed by the surplusage 15.

It will be recognised that when layer 12 is place atop layer 11 as shown in FIGS. 2(*a*) to (*e*), an underfoot seam results if the intended top of the hose H is constituted by layer 12. Should the intended bottom of the hose be constituted by layer 12, an overfoot seam results so long as layer 12 is atop layer 11.

The actual seam S will be arcuate even though it may be sewn along a straight seam line SL. As the tubular blank H is knitted, its rows or courses of stitches run helically. When the blank is in the laid-flat condition, these courses extend transversely, to all intents and purposes. See FIG. 3(*a*), the courses being indicated by reference 18. Upon displacing one layer 12 relative to the other layer 11, th courses 18 in layer 12 become arcuately distorted, see FIG. 3(*b*), when the surplusage 15 is created. If the seam S is generated along a straight seam line and the laid-flat condition is thereafter removed, the courses will straighten towards their original configuration and the seam will take on a curved form.

The seam line SL can be arcuate, in which case the ultimate seam S can have a more or less pronounced curve and the toe portion 16 can thus be made deeper or shallower. A variety of toe forms can be obtained by varying (i) the shape of the seam line SL and (ii) the magnitude of the mutual displacement between the layers 11, 12.

Apparatus according to the invention for performing the method is shown diagrammatically in FIGS. 4 to 6. The apparatus 20 can be an adaptation of the equipments fully disclosed in the Detexomat patents noted hereinbefore and incorporated in this specification by reference. In view of the prior patents, and for simplicity, we do not describe such items as devices for loading and unloading the apparatus or devices for correctly positioning hose blanks thereon, although such devices may beneficially be incorporated in the apparatus 20.

The apparatus 20 comprises a carrier 21 for supporting a hose blank H with at least the toe portion in a laid-flat condition. The carrier 21 comprises a pair of coplanar spaced-apart flat blades 22, 24 or the like. When a blank is placed on the blades, its fabric is stretched laterally and laid flat. The blades 22, 24 can, if desired, be laterally movable for stretching the blank H, in a manner akin to a glove stretcher. Optionally, but advantageously, the carrier 21 includes a suction tube 25 for everting the blank H in the course of mounting it on the apparatus and, if desired, in the course of unloading it therefrom after toe closing.

The apparatus 20 can include a plurality of movable carriers 21, e.g. mounted on a rotatable turret for movement in turn past the seamer.

Prior to seaming, the hose blank toe end is presented to a clamping mechanism. The clamping mechanism serves to grip the hose toe end portion along a predetermined seaming line and to convey it past the sewing head 27 of a sewing machine 28. Most expeditiously, the blades 22, 24 are movable to and fro to serve as means to present the toe end to the clamping mechanism. The blades are in a withdrawn position for receiving a hose blank H and are advanced forwardly for presenting its toe end into the clamping mechanism.

As is known in the art, the clamping mechanism can take various forms. By way of example, the illustrated clamping mechanism comprises an endless flexible belt 30 trained around a plurality of pulleys or other guides 32, and a coacting support 34 beneath the belt. The support 34 extends to and past the seaming head 27 and includes an upstream support portion 35 and a downstream portion 36. The upstream portion 35 is hinged about an axis 38. Portion 35 can move from a lowered position for the clamp to receive the toe end of blank H, to a raised position which is coplanar with the downstream support portion 36. The clamp is open or closed, depending on whether support portion 35 is lowered or raised level with portion 36. When the clamp has been closed, the belt 30 is movable, by drive means not shown, to convey a clamped toe end to and past the seamer 28.

Means 40 are provided for taking a hold of the hose toe end portion, effectively to immobilise the layer 11 preparatory to establishing the aforesaid displacement. The holding means 40 can be realised in various forms and is illustrated here by a ram 41 which actuates a holding element 42. In this embodiment, the holding means 40 is located at or adjacent the hose-receiving part of the clamping mechanism. The holding element can then conveniently coact with the support 35 frictionally to grip layer 11. Alternatively, element 42 can incorporate impaling pins for entering the toe end at locations X, FIG. 2(*a*), to immobilise it enabling layer 12 to be displaced relative to layer 11.

Allied with holding means 40 is means 45 for displacing layer 12 longitudinally relative to layer 11. Displacing means 45 can also be realised in various forms and in the present example is generally similar to holding means 40. Thus, displacing means 45 comprises a fabric-gripping element 46 and an actuating ram 48 therefor. Element 46 can grip the fabric frictionally or mechanically by way of impaling pins, hooks or the like. As shown, element 46 embodies a pad comprising an elastomeric foam material which can frictionally engage the hose H between itself and a part of the carrier, such as the suction tube 25. The displacing means 45 is mounted or arranged in such a manner that element 46 can be moved into or out of a hose-engaging position. When the ram 48 is activated, the element 46 is shifted in a longitudinal direction A relative to the carrier 21 to exert a pull on layer 12 engaged thereby. The ram stroke is arranged to displace layer 12 relative to layer 11 in a predetermined distance as described hereinbefore.

The holding means 40 and displacing means 45 serve to establish the required mutual displacement between the layers 11, 12 prior to the clamp mechanism seizing the hose toe end. Thereafter, the said means 40, 45 disengage from the hose and the belt 30 of the clamp mechanism proceeds to advance the toe end to the seamer 28 while maintaining the mutual displacement.

Operation of the apparatus 20 is as follows. Initially, the blades 22, 24 are in a withdrawn position with their free ends spaced from the clamp mechanism. The upstream portion 35 of support 34 is lowered so the clamp mechanism is open, and the holding and displacing means 40, 45 are in inoperative states, i.e. with elements 42, 46 raised away from their operative positions. In this condition of the apparatus, the operator loads a tubular hose blank H on the carrier 21. The operator may position the toe end appropriately, for which purpose, the carrier 21 can include alignment markings, not shown. Alternatively, the task of positioning the toe end can be accomplished automatically by known positioning means. Having loaded the hose, the operator hits a start button or pedal, or the apparatus commences operation after a timed delay designed to permit the operator to load the hose blank H. During the operation of the apparatus, the blades 22, 24 of the carrier advance as a unit to position themselves and the toe end of the blank into the open clamp mechanism. The latter then commences to close, but no actual clamping of the hose toe end occurs yet. The apparatus is then in the condition represented in FIG. 4.

Next, the holding means 40 and displacing means 45 are activated. The holding element 42 is engaged with the toe end, effectively immobilising layer 11 thereof, (as shown in FIG. 5) and the displacing means 45 is activated to engage its displacing element 46 with the layer 12 of the hose blank H and to shift element 46 in direction A. FIG. 5 shows the displacing means in the course of its fabric-displacing operation.

When layer 12 has been displaced relative to layer 11 a predetermined distance, ram 48 stops but elements 42 and 46 continue to maintain their hold on layers 11 and 12 of the hose blank. The clamp mechanism then finally closes onto the toe end by the support portion 35 being lifted level with support portion 36. Once closed, the clamp mechanism holds the layers 11 and 12 to their mutually displaced relationship, and thereupon the means 40 and 45 can be disengaged from the hose blank H. The blades 22, 24 are also retracted from their advanced position under the clamp mechanism. The toe end of the blank is then ready to be conveyed past the seamer 30. At this time, the apparatus is in the condition illustrated in FIG. 6.

For generating the seam, the belt of the clamp mechanism is caused to move so as to convey the clamped toe end along the support 34 towards and past the seaming head 27. During this movement, the grip exerted by the belt on the hose toe end preserves the relative displacement between the layers 11, 12. The seam line along which the seam is sewn is determined by the shape of the belt 30 at the hose receiving portion of the clamp mechanism. As shown, the guides or pulleys 32 here may shape the belt to a curve, which is reproduced as a correspondingly curved seam line as the blank passes the seaming head 27. As aforesaid, the seam line may be linear instead, in which case the portion of belt 30 which seizes the toe end on closure of the clamp mechanism will be straight. Our aforesaid patents GB-B-1,501,869 and GB-B-1,577,758 should be read for further details of the construction and operation of the clamp mechanism.

After seaming and trimming has been performed, the hose can be manually or automatically discharged from the apparatus 20, and if desired everted in the process. For further details, see our aforementioned patent specifications.

When the seamed blank is released from the clamp mechanism and is freed from the laterally stretched laid-flat condition, the fabric will readjust itself and the layers (11, 12) will resume their normal relaxed relative dispositions. The surplusage 15 will therefore so disperse itself that it will form the hose toe and the seam S will move into an overfoot or underfoot position.

The blades 22, 24, the clamp mechanism, the holding and displacing mechanism 40, 45 and the belt drive all function in timed relationship to one another. The sequencing can be governed by mechanical operators such as cams, as is well known in the toe closing art.

The invention can be practised in ways other than described above. For example, the displacing means 45 need not coact with the suction tube for gripping the hose, and it need not be positioned as shown to operate on the centreline of the carrier 21. If it operated offset from the centreline, the seam would be asymmetrical and this may be quite appropriate in some circumstances.

An alternative displacing means, see FIG. 7, comprises a movable plunger 50 disposed to be extended into the open end of the suction tube 25. With the hose toe portion supported by the blades 22, 24 one, e.g. the upper layer 12 of the fabric is suitably immobilised by the holding means 40. The plunger is then activated to move a predetermined distance into the tube 25. As it moves, the plunger 50 thrusts a portion of the other layer 11 of fabric rearwardly into the tube 25. The action of the plunger displaces the said other, e.g. the lower, fabric layer and establishes the required preseaming condition of the toe end.

As illustrated and described, with reference to FIGS. 2 to 6, the mutual displacement of layer 11, 12 is brought about by accumulating a fabric surplusage 15 in layer 12. By a straightforward relocation of the means 40, 45, the surplusage could be created in layer 11 while layer 12 is held immobile.

Another possible modification to the technique establishes the required mutual displacement by stretching one layer longitudinally relative to the other, which is suitably immobilised.

The required mutual displacement could be attained by a combination of the techniques outlined above. Thus, one layer could be stretched longitudinally while the other layer is displaced longitudinally in the opposite direction so as to accumulate a fabric surplusage in the latter. In effect, fabric displacing forces are exerted on the two layers in opposite longitudinal directions.

Toe closers are known which dispense with clamping mechanisms and means to present a hose toe end thereto. In such a toe closer, a hose blank is mounted on a carrier which is arranged to execute a movement past the seamer. The latter generates a toe closing seam across the passing blank, in a portion thereof which protrudes just beyond a free end of the carrier. The carrier comprises a pair of blades which maintain the toe portion of the blank in a laid-flat condition suitable for seaming. Such a toe closing arrangement could be used for practising the present invention, when means will be required to establish the mutual displacement between the fabric layers and maintain it during seaming. The said means could be realised by a first means to immobilise a part of the toe end and a second means which engages, pulls and stretches one of the layers forwardly with respect to the other. Said first and second means would be movable with the carrier and, having established a predetermined displacement, would retain it until the seam has been generated. The first and second means can comprise suitable fabric gripping devices and the second means is operable, for instance by a ram, through a predetermined forward pulling stroke extending generally longitudinally relative to the carrier.

FIG. 8(*a*)–(*c*) illustrates the principles of operation of such a toe closer. In FIG. 8(*a*), the hose blank H is mounted on the blades 22, 24 of the moving carrier 21 and the first and second means are indicated at 40, 45. The carrier moves in the direction of arrow A. In FIG. 8(*b*), the blades 22, 24 have opened to spread the toe end of the blank H into a laid-flat condition. Moreover, the first means 40 has moved into contact with one layer 11 of the blank while the second means 45 has suitably gripped layer 12 and pulled this layer forwardly, displacing it relative to the substantially immobilised layer 11. In FIG. 8(*c*), the carrier is moving the hose toe end past the sewing head 27 of the seamer, generating the seam S along the seam line SL. The first and second means 40, 45 remain in their respective positions of FIG. 8(*b*) during the seaming operation.

Also known are toe closers having a carrier and a clamping mechanism, in which the carrier itself does not advance the toe end of a hose blank into the clamping mechanism. A separate reciprocally-operable clamp-loading device is incorporated in such a toe closer. The loading device reciprocates from the hose carrier, from which it takes hold of the hose toe end, and into the clamping mechanism. The device functions to stretch the toe end laterally, into a laid-flat condition, before the fabric is gripped by the clamping mechanism. It will be recognised that such a toe closer could embody means according to this invention at the clamping mechanism for effecting the required displacement between the confronting fabric layers prior to the clamping mechanism gripping the fabric.

By varying the magnitude of the mutual displacement and/or by varying the configuration of the seam line (by adjusting the belt shape at the hose-receiving portion of the clamp mechanism), considerable control over the toe depth and shape and the seam position in the finished sock can be readily realised.

Those skilled in the art will recognise, or be able to ascertain using no more than routine experimentation, equivalents to the specific procedures and mechanical arrangements described herein. Such equivalents are considered to be within the spirit and scope of this invention and are covered by the following claims.

I claim:

1. A method for closing the toe of a tubular hose blank comprising the steps of:

(a) placing said blank in a flattened condition defining juxtaposed layers at an open end of same;

(b) longitudinally displacing one of said layers with respect to said other layer; and (c) joining said layers along a predetermined line across said blank while maintaining the relative displacement between said layers.

2. A method according to claim 1, wherein said one layer is displaced rearwardly relative to said other layer, away form an end edge of the latter layer.

3. A method according to claim 1, wherein said displacement is established by moving said layers in opposite directions.

4. A method according to claim 1, wherein said other layer is restrained from displacement while the said one layer is displaced relative thereto.

5. A method according to claim 4, wherein a hold is taken on the blank adjacent said end thereof for restraining said other layer from displacement, and a hold is taken on said one layer by movable holding means which is thereafter displaced longitudinally away from the end edge of said other layer, and wherein after the said displacement is established, the two layers are clamped to retain the displacement while said layers are joined along the predetermined line across the blank.

6. A method according to claim 1, wherein after establishing said displacement, said layers are introduced into clamping means responsible for retaining said displacement and for moving said toe end past means operative to join said layers along the predetermined line.

7. A method according to claim 1, wherein said layers are joined along a predetermined, curved line.

8. Apparatus for closing the toe of a tubular hose blank comprising:

(a) means for mounting said blank in a flattened condition with juxtaposed layers at an outer, open end of same;

(b) means for relatively displacing one of said blank layers longitudinally with respect to said other layer and maintaining the longitudinal relative displacement; and (c) means for joining said blank layers along a predetermined line across said blank while said longitudinal relative displacement is maintained.

9. Apparatus according to claim 8, wherein the displacing means is engageable with said blank and comprises holding means to substantially immobilise a first of said layers and movable displacing means to move the second of said layers, away from an end of said first layer, in a direction forwardly of said blank.

10. Apparatus according to claim 9, wherein said holding and movable displacing means include elements, for non-slippable engagement with said layers, selected from friction pads, impaling pins, hook means and the like.

11. Apparatus for closing the toe of a tubular hose blank comprising:

(a) means for mounting said blank in a flattened condition with juxtaposed layers at an outer, open end of same;

(b) means for relatively displacing at least one of said layers with respect to the other layer to establish a predetermined mutual displacement between said layers;

(c) clamping means for receiving a toe end of said blank supported on said mounting means; and (d) means for joining said layers along a predetermined line across said blank; said clamping means being operative (i) to grip said toe end after establishment of said displacement, (ii) to convey said toe end past the joining means for the latter to join the layers along said line and (iii) to preserve said displacement while conveying said toe end past the joining means.

12. Apparatus according to claim 11 further including holding means adjacent said clamping means for taking a hold on the fabric thereby effectively to immobilise said other layer while said displacing means is displacing said one layer.

13. Apparatus according to claim 12, wherein said holding means comprises an element selected from a friction gripper, impaling pins and hooked element engageable with said toe end.

14. Apparatus according to claim 11, wherein said displacement means comprises a reciprocally-movable element engageable with said one layer, said element being disengageable therefrom after executing a displacing stroke when the clamp has gripped the toe end.

15. Apparatus according to claim 14, wherein the said element is selected from a friction pad, a plunger, impaling pin means and hook means for operatively engaging the second layer.

16. Apparatus according to claim 11, wherein said clamping means comprises an endless flexible belt and a cooperating support between which said toe end is gripped, said belt being movable to advance said toe end across the support past the joining means.

17. Apparatus according to claim 16, wherein said clamping means comprises belt-shaping means at a toe end receiving part of the clamping means, which cause said belt to grip the toe end along a predetermined line corresponding to the configuration of said predetermined line.

18. Apparatus according to claim 8, wherein said mounting means comprises a pair of flat fingers which are movable apart to stretch said toe end laterally to establish said flattened condition.

19. Apparatus according to claim 18, wherein said fingers are associated with a suction tube for everting said blank.

20. Apparatus according to claim 11, wherein said mounting means comprises a pair of flat fingers which are movable apart to stretch said toe end laterally to establish said flattened condition.

21. Apparatus according to claim 20, wherein said fingers are associated with a suction tube for everting said blank.

22. Apparatus according to claim 11, wherein said mounting means are mounted for movement towards said clamping means for positioning a toe end for receipt thereby and for operative engagement by said displacement means.

* * * * *